US005651547A

United States Patent [19]

Rannelli

[11] Patent Number: 5,651,547

[45] Date of Patent: Jul. 29, 1997

[54] PORTABLE PUZZLE STORAGE BOARD

[76] Inventor: Thomas D. Rannelli, 68 Galway Court, Sudbury, Ontario, Canada, P3A 3W1

[21] Appl. No.: 662,717

[22] Filed: Jun. 10, 1996

[51] Int. Cl.[6] ..... A63F 9/10

[52] U.S. Cl. ..... 273/157 R

[58] Field of Search ..... 273/157 R, 309, 273/148 R; 108/115; 269/329

[56] References Cited

U.S. PATENT DOCUMENTS

| | | | |
|---|---|---|---|
| 4,142,726 | 3/1979 | Anderson | 273/157 R |
| 4,154,339 | 5/1979 | Dutra | 273/157 R X |
| 4,436,307 | 3/1984 | Caldwell | 273/157 R |
| 4,479,651 | 10/1984 | LaFleur | 273/157 R |
| 4,486,018 | 12/1984 | Keller, Jr. | 273/157 R |
| 4,552,361 | 11/1985 | LaFleur | 273/157 R |
| 4,687,202 | 8/1987 | Palma | 273/157 R |
| 5,219,168 | 6/1993 | Morris | 273/157 R |

*Primary Examiner*—Raleigh W. Chiu
*Attorney, Agent, or Firm*—Mary B. Sprigings; Arne I. Fors

[57] ABSTRACT

A portable puzzle storage board provides an assembly surface for jigsaw type puzzles and a simple mechanism for securing the puzzle pieces in place. The pieces are secured with a flexible cover which may be easily engaged and disengaged with the retainer frame of the puzzle storage board to provide a simple and quick way of storing a completed puzzle or partially assembled puzzle. The puzzle storage board is comprised of a flexible cover, a retainer frame having a convex base for receiving the puzzle pieces, and a recess for securing the flexible cover to the retainer frame for retaining the puzzle pieces.

9 Claims, 2 Drawing Sheets

PORTABLE PUZZLE STORAGE BOARD

BACKGROUND OF THE INVENTION

1. Field of the Invention

This invention relates to a puzzle container which provides a surface for assembling the pieces of a jigsaw type puzzle and provides means for storing the puzzle pieces therein.

2. Discussion of Related Art

The puzzle containers of the prior art typically are directed to specific puzzles and apparatuses for their containment therein. These prior art puzzle apparatuses are designed for specific puzzles and do not provide a means for storing and assembling a variety of different sized puzzles. For example, U.S. Pat. No. 4,142,726 describes a laminated jigsaw puzzle in which the pieces of the puzzle are designed so that they can be bent for insertion under the ledge of a picture frame assembly.

There are prior art puzzle containers which disclose means for containing and securing the pieces of a puzzle. These prior art puzzle containers are complicated and not appropriate to varying puzzle thicknesses. In U.S. Pat. No. 4,687,202, a puzzle box is disclosed which has a top portion with sidewalls which are used to interengage the sidewalls of a bottom portion to secure the puzzle pieces between the top and bottom portions. In U.S. Pat. No. 4,154,339, a container is disclosed in which puzzle pieces are held in position with a lid. The lid comprises a hard top surface with a resilient pad underneath. The lid can be lodged using grommets within groves of the frame and the resilient pad underneath presses against the puzzle pieces which rest on a flat backing surface.

SUMMARY OF THE INVENTION

The present invention provides an assembly surface for jigsaw type puzzles and a simple mechanism for securing the puzzle pieces in place. The pieces are secured with a flexible cover which may be easily engaged and disengaged with the retainer frame of the puzzle to provide a simple and quick means of storing a completed puzzle or partially assembled puzzle.

The puzzle storage board of the present invention is comprised of a flexible cover, a retainer frame having a convex base for receiving said puzzle pieces, and a means for securing said flexible cover to said retainer frame for retaining said puzzle pieces.

The base of the puzzle storage board is convex in shape to minimize the tendency of the puzzle pieces to become displaced. The flexible cover when engaged with the retainer frame comes in contact with the convex base and puzzle pieces which have been placed on the convex base. The flexible cover together with the convex base provides a minimum uniform force on all areas of the puzzle surface for securing the puzzle pieces in place on the convex base.

The working surface provided by the convex base receives the components of a jigsaw puzzle, and when it is desired to transport or store the puzzle, the flexible cover is placed over the working surface to sandwich the pieces of the puzzle between the cover and the convex base. The flexible cover is inserted into a deep recess which is formed in one end of the retainer frame and is then depressed and slid into a relatively shallow recess at the opposite end of the retainer frame. Preferably the flexible cover is transparent for viewing. In a particular preferred embodiment, the flexible cover is plexiglass.

The present invention provides a portable working surface which can be used indoors, outdoors or in vehicles. Additionally, a puzzle can be displayed in the storage board for viewing. When the flexible cover is engaged with the retainer frame, the assembled and unassembled pieces of the puzzle are immobilized and confined regardless of the position in which the puzzle storage board is kept.

In its broad aspect, the puzzle storage board and container for pieces of a jigsaw type puzzle of the invention comprises a retainer frame having a compressible convex base for receiving said puzzle pieces on said base, a flexible transparent cover adapted to overlay said convex base, and means for securing said flexible transparent cover to said retainer frame whereby the flexible cover substantially abuts the puzzle pieces and compresses the puzzle pieces against the convex base for retaining and storing said puzzle piece. The means for securing said flexible cover to the retainer frame comprises a deep recess at one end of the retainer frame for receiving an end of the flexible cover therein and a relatively shallow recess at an opposite end of the retainer frame for receiving an opposite end of the flexible cover by depressing and sliding the opposite end of the flexible cover into the shallow recess at the said opposite end of the retainer frame. A locking device preferably is provided to prevent the flexible cover from disengaging from the retainer frame.

The convex base is comprised of a resilient material and an impermeable support surface which defines a space between the support surface and flexible cover for storing puzzle pieces when the flexible cover is secured to the retainer frame. The flexible cover preferably is transparent and is formed from plexiglass. More particularly, the puzzle storage board and container comprises a rectangular retainer frame of wood or rigid plastic having a convex base for receiving pieces of a puzzle, said retainer frame having spaced-apart upstanding side walls and spaced-apart upstanding end walls, one end wall having a deep recess formed therein and the other end wall having a relatively shallow recess formed therein, said convex base being comprised of a resilient material and a support surface, wherein the resilient material is foam material and the support surface is vinyl, and wherein the convex base has an arch in the middle of said convex base having a height of about 5/16 of an inch. A flexible transparent planar cover has an end insertable into the deep recess at one end of the retainer frame and an opposite end capable of being depressed and slid into the shallow recess at the opposite end of the retainer frame. The deep and shallow recesses are of equal height, each said recess being equivalent to the thickness of the flexible cover, plus 3/32 to 1/8 of an inch, plus the thickness of the fully depressed resilient material.

BRIEF DESCRIPTION OF THE DRAWINGS

These and other features of the invention will be more clearly understood from a consideration of the following description taken in connection with the accompanying drawings, in which.

DETAILED DESCRIPTION

Figure 1:
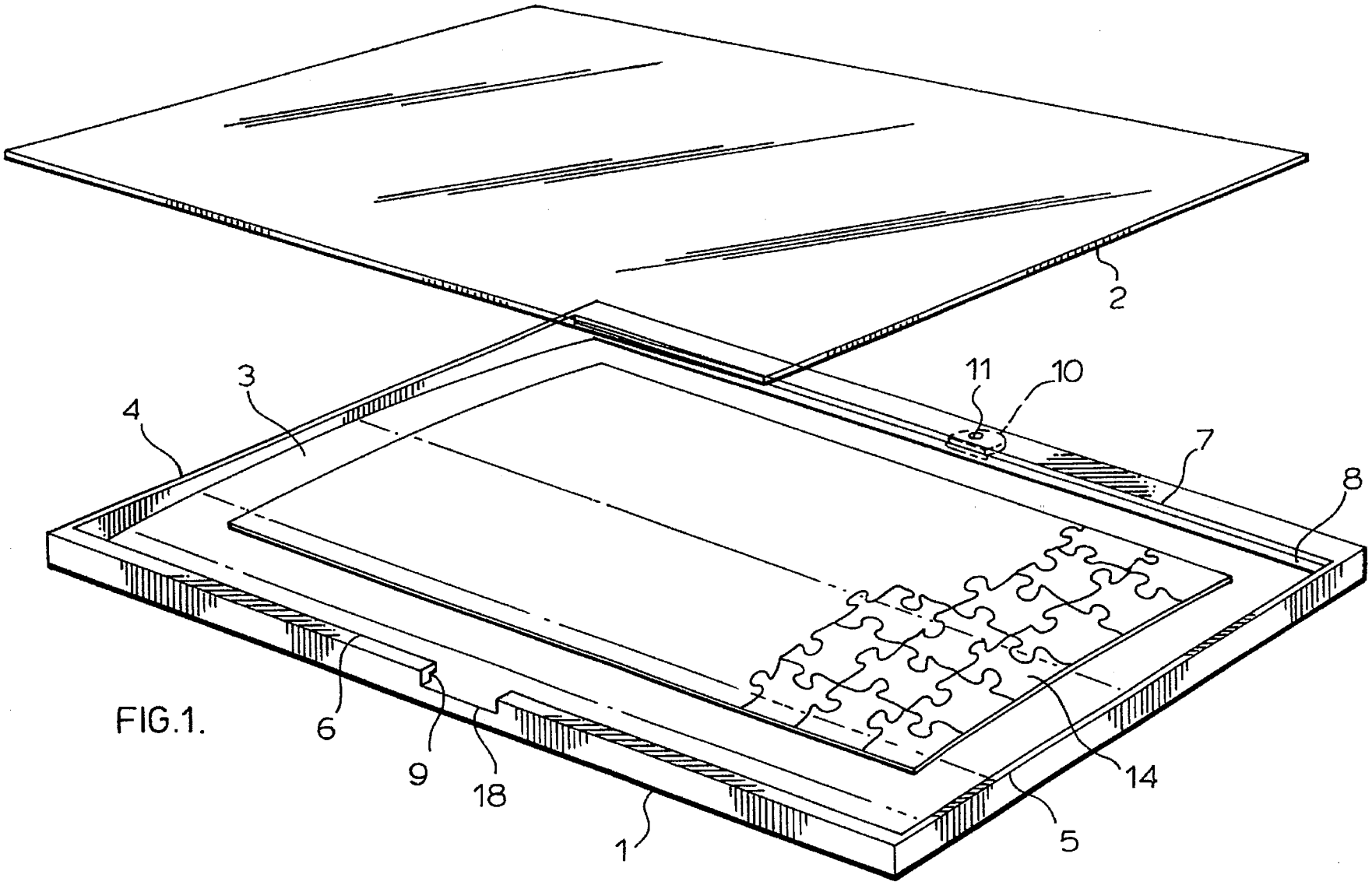
FIG. 1 is a top perspective view of the puzzle storage board of the present invention.

Referring to FIGS. 1–5 of the drawings, the puzzle storage board is comprised of a rectangular retainer frame 1 and matching, transparent flexible cover 2. The retainer frame 1 is comprised of a transversely convex base 3, and shallow, upstanding side walls 4 and 5 and end walls 6 and 7. A deep recess 8 is formed in the inner side of end wall 7 and a relatively shallow recess 9 of about one-half the depth of recess 8 formed in the opposed side of end wall 6, for reasons which will become apparent as the description proceeds.

The convex base 3 should provide a semi-hard upper surface with the ability to compress or deform. Consequently, the convex base 3 is preferably comprised of an underlying compressible resilient material 12 such as foam material and a superposed resilient and smooth material 13 such as vinyl plastic disposed over a rigid underlying support surface 17.

The compressible resilient material 12 should be able to retain its ability to be deformed over repeated and lengthy periods of deformation. However, if the resilient material 12 of the convex base 3 is too soft or deep, the puzzle pieces will become displaced from each other and will be difficult to assemble. Displacement will occur when one side of a first puzzle piece is depressed in an attempt to lock a second puzzle piece in place causing the first piece to become dislodged from the rest of the assembled puzzle.

The curvature of the convex base 3 must not be too great as to require an excessive amount of force to close the flexible cover 2 nor should the curvature of the convex base 3 be too small such that the convex base 3 does not form an adequate surface for depressing puzzle pieces of different sizes. The curvature must provide an efficient combination of applied force and bed deformation. In a particular suitable embodiment, the height of the arch in the middle of the convex base 3 is approximately 5/16 of an inch for a width of 22 inches.

Generally, puzzles come in two thicknesses: a senior puzzle thickness of about 3/64 of an inch which is thinner and used in more complex puzzles and a junior puzzle of greater thickness of about 1/16 of an inch for simpler puzzles. Resilient material 12 and material 13 which have a combined deformation of approximately 3/32 to 1/8 of an inch, which is about the thickness of two senior puzzle pieces or one junior puzzle piece, is preferred.

The resilient upper material 13 of the convex base 3 should preferably be in a contrast colour to the colour of the puzzle 14 to facilitate easy assembling of the puzzle 14. Furthermore, the resilient material should be impermeable and resistant to liquids to prevent damage from the spilling of refreshments and should have a smooth texture to provide for the easy removal of debris.

Preferably, the flexible cover 2 will be transparent and formed from 3/16 inch thick plexiglass. It is preferred that either side of the flexible cover 2 be capable of being used so that the flexible cover does not become molded to the contour of the convex base 3 after lengthy storage. If the flexible cover becomes molded, it will no longer retain the puzzle pieces properly because it will not be frictionally engaged with the lips 15 and 16 of the end walls 7 and 6, respectively.

It is also preferable that the flexible cover 2 have shallow recesses (not shown) finger grips machined into each surface of the cover in proximity to each end edge of the cover to facilitate engaging and disengaging the flexible cover 2 within the retainer frame 1. The edges on the flexible cover 2 should be rounded and smooth to ensure that the edges do not damage the convex base 3, retainer frame or surface of the puzzle.

The height of each recess 8 and 9 should be identical. The height of the recesses 8 and 9 is the factor which determines the range of puzzle thicknesses which will be accommodated. Preferably, the height of each recess 8 and 9 should be equivalent to the thickness of the cover 2 plus twice the thickness of a conventional senior level piece of puzzle or one junior level piece (3/32 to 1/8 of an inch) plus the thickness of the fully depressed compressible bed material 12 and 13.

An important feature of the retainer frame 1 is to secure the flexible cover 2 in its closed position. To accomplish this, the dimensions of recesses 8 and 9 in the retainer frame 1 must be machined to within careful tolerances. These dimensions must be uniform along the entire length of each recess 8 and 9.

The retainer frame 1 and cover base 3 can be constructed of any wood or plastic material such as rigid vinyl which is suitable and cost effective for its purposes. The type of material used to fabricate the retainer frame 1 must be selected so the flexible cover 2 is frictionally engaged with lips 15 and 16 of the retainer frame 1 when the flexible cover 2 is in its closed position. However, the frictional force should not be too great as the flexible cover 2 should be capable of being removed by a child or weakened individual. Should the combination of materials for the retainer frame 1 and flexible cover 2 create too great a frictional force, the total force required to position the cover in its closed position can be adjusted by reducing the contact area between the two surfaces.

An indicator and finger access 18 preferably is formed in the bottom wall 6 of the retainer frame 1. This allows one to visually check whether or not the flexible cover 2 is in a completely closed position. In addition, the finger access 18 facilitates easy removal of the cover.

The side walls 4 and 5 of the retainer frame 1 do not require any recesses. However, the side walls 4 and 5 must be machined with an arch identical to that of the convex base 3. This eliminates any stress which might otherwise deform the contour of the convex base 3.

Figures 2, 3, 4, 5:
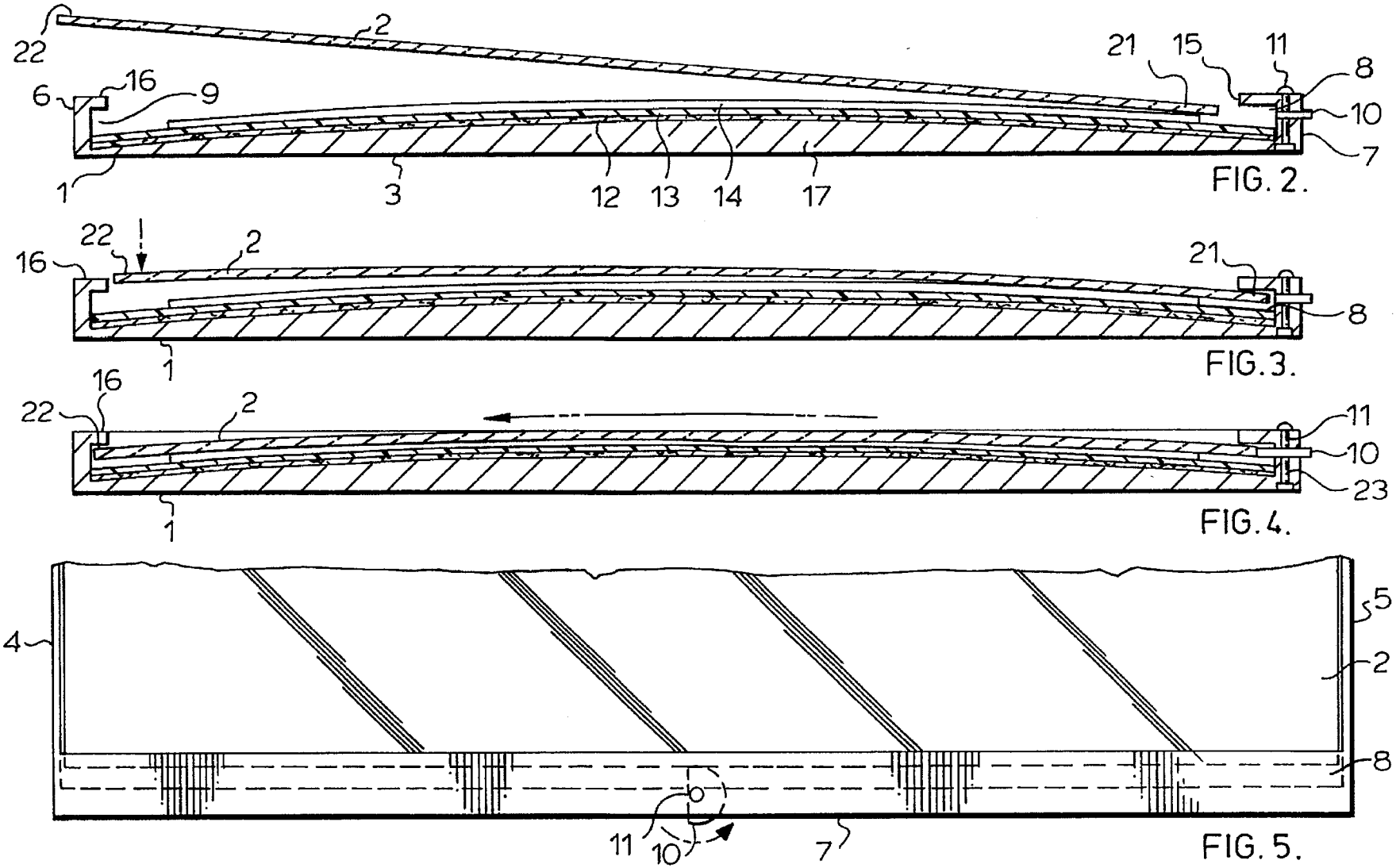
FIG. 2 is a side perspective view of the said puzzle storage board preparatory to insertion of the flexible cover into a deep recess at one end of the retainer frame.
FIG. 3 is a side perspective view of the puzzle storage board illustrating the depression of the flexible cover for insertion into a shallow recess at the opposite end of the retainer frame.
FIG. 4 is a side perspective view of the puzzle storage board illustrating the flexible cover in the closed position.
FIG. 5 is a fragmentary top plan view of the puzzle storage board illustrating an embodiment of the locking device mechanism.

Referring now to FIGS. 2–4, the sequence of steps in the process for engaging the flexible cover 2 with the retainer frame 1 is illustrated. A first end 21 of the flexible cover 2 is inserted into the deep recess 8 in the inner face at wall 7 (FIG. 3). Using the lip 15 of the wall 7 for leverage, the opposite end 22 of the flexible cover 2 is depressed. Once the opposite end 22 of the flexible cover 2 is below the height of the lip 16 of the bottom wall 6, the said end 22 of the flexible cover can be slid into recess 9 of wall 6 (FIG. 4). The flexible cover 2 is then held in place by frictional engagement with lips 15 and 16 and locking device 10.

The locking device 10, as illustrated more clearly in FIGS. 1, 4 and 5, is a cam rotationally mounted in wall 7 by pin 11 and juxtaposed with the flexible cover 2 by rotating the cam 10 about pin 11. The locking device 10 prevents the flexible cover 2 from disengaging from the retainer frame 1 by sliding past lip 16 of the wall 7.

The flexible cover 2 thus is locked in place and effectively sandwiches the puzzle 14 between the flexible cover 2 and the convex base 3.

It will be understood, of course, that modifications can be made in the embodiment of the invention illustrated and described herein without departing from the scope and purview of the invention as defined by the appended claims.

What is claimed is:

1. A puzzle storage board and container for pieces of a jigsaw type puzzle comprising a retainer frame having a compressible convex base for receiving said puzzle pieces on said base;

a flexible transparent cover adapted to overlay said convex base;

and means for securing said flexible transparent cover to said retainer frame whereby the flexible cover substantially abuts the puzzle pieces and compresses the puzzle pieces against the convex base for retaining and storing said puzzle pieces.

2. A puzzle storage board and container as claimed in claim 1 wherein the means for securing said flexible cover to the retainer frame comprises a deep recess at one end of the retainer frame for receiving an end of the flexible cover therein and a relatively shallow recess at an opposite end of the retainer frame for receiving an opposite end of the flexible cover by depressing and sliding the opposite end of the flexible cover into the shallow recess at the opposite end of the retainer frame.

3. A puzzle storage board as claimed in claim 2 additionally comprising a locking device to prevent the flexible cover from disengaging from the retainer frame.

4. A puzzle storage board as claimed in claim 2 wherein the flexible cover and convex base form a defined space therebetween for storing puzzle pieces when the flexible cover is secured to the retainer frame.

5. A puzzle storage board as claimed in claim 4 wherein the convex base is comprised of a resilient material and an impermeable support surface.

6. A puzzle storage board as claimed in claim 5 wherein the height of the deep recess is equal to the height of the shallow recess.

7. A puzzle storage board as claimed in claim 5 wherein the flexible cover is transparent.

8. A puzzle storage board as claimed in claim 7 wherein the flexible transparent cover is plexiglass.

9. A puzzle storage board comprising: a rectangular retainer frame of wood or rigid plastic having a convex base for receiving pieces of a puzzle, said retainer frame having spaced-apart upstanding side walls and spaced-apart, upstanding end walls, one end wall having a deep recess formed therein and the other end wall having a relatively shallow recess formed therein, said convex base being comprised of a resilient material and a support surface, wherein the resilient material is foam material and the support surface is vinyl, and wherein the convex base has an arch in the middle of said convex base having a height of about 5/16 of an inch, and a flexible transparent planar cover, an end of said flexible transparent cover being insertable into the deep recess at one end of the retainer frame and an opposite end of the flexible transparent cover being capable of being depressed and slid into the shallow recess at the opposite end of the retainer frame, wherein the deep and shallow recesses are of equal height, and wherein each said recess is equivalent to the thickness of the flexible cover, plus 3/32 to 1/8 of an inch, plus the thickness of the fully depressed resilient material.

* * * * *